US008464669B2

(12) United States Patent
Honzen et al.

(10) Patent No.: US 8,464,669 B2
(45) Date of Patent: Jun. 18, 2013

(54) COOLING CIRCUIT FOR AN INTERNAL COMBUSTION ENGINE

(75) Inventors: Matthias Honzen, Ludwigsburg (DE); Markus Koehne, Koenigswinter (DE); Volker Boestfleisch, Neckarsulm (DE); Hermann Henning, Ellhofen (DE)

(73) Assignee: Audi AG, Ingolstadt (DE)

( * ) Notice: Subject to any disclaimer, the term of this patent is extended or adjusted under 35 U.S.C. 154(b) by 258 days.

(21) Appl. No.: 13/042,632

(22) Filed: Mar. 8, 2011

(65) Prior Publication Data

US 2011/0214628 A1 Sep. 8, 2011

(30) Foreign Application Priority Data

Mar. 8, 2010 (DE) ..... 10 2010 010594

(51) Int. Cl.

| | |
|---|---|
| ***F01P 3/20*** | (2006.01) |
| ***F01P 3/00*** | (2006.01) |
| ***F01P 9/00*** | (2006.01) |
| ***F01P 7/14*** | (2006.01) |

(52) U.S. Cl.

USPC ..... 123/41.51; 123/41.01; 123/41.08; 123/41.09; 123/41.29

(58) Field of Classification Search

USPC ..... 123/41.08, 41.01, 41.09, 41.29, 41.51

See application file for complete search history.

(56) References Cited

U.S. PATENT DOCUMENTS

| | | | | |
|---|---|---|---|---|
| 4,726,324 | A * | 2/1988 | Itakura | 123/41.1 |
| 5,121,714 | A * | 6/1992 | Susa et al. | 123/41.1 |
| 6,182,618 | B1 * | 2/2001 | Gutierrez, Jr. | 123/41.29 |
| 6,457,442 | B1 * | 10/2002 | Fuchs et al. | 123/41.29 |
| 2003/0000487 | A1 * | 1/2003 | Schmitt | 123/41.72 |
| 2005/0166870 | A1 * | 8/2005 | Wenderoth et al. | 123/41.01 |
| 2006/0157002 | A1 * | 7/2006 | Pfeffinger et al. | 123/41.29 |
| 2009/0114171 | A1 * | 5/2009 | Hayashi | 123/41.44 |
| 2011/0214627 | A1 * | 9/2011 | Nishikawa et al. | 123/41.02 |
| 2012/0103283 | A1 * | 5/2012 | Mehring et al. | 123/41.02 |

FOREIGN PATENT DOCUMENTS

| | | | |
|---|---|---|---|
| DE | 3317454 | A1 | 11/1984 |
| DE | 10119969 | A1 | 10/2002 |
| DE | 10226904 | A1 | 5/2003 |
| DE | 10302170 | A1 | 8/2004 |
| DE | 10332947 | A1 | 2/2005 |
| DE | 102005004778 | A1 | 8/2005 |
| DE | 102004052137 | A1 | 5/2006 |
| EP | 1233170 | A2 | 8/2002 |
| JP | 2004324459 | A | 11/2004 |

* cited by examiner

*Primary Examiner* — Lindsay Low
*Assistant Examiner* — Tea Holbrook
(74) *Attorney, Agent, or Firm* — Novak Druce Connolly Bove + Quigg LLP

(57) ABSTRACT

Cooling circuit for an internal combustion engine 2, having an internal combustion engine with at least one cylinder head and one crankcase, a coolant pump, a primary heat exchanger, and a heat exchanger for an operating medium of the internal combustion engine, the cooling circuit 1 downstream of the coolant pump being divided between a branch site A and a connection site B so that at least one cylinder head is incorporated in a cylinder head branch circuit and the crankcase is incorporated in a crankcase branch circuit and the heat exchanger for an operating medium being located in the cylinder head branch circuit downstream of the at least one cylinder head.

16 Claims, 1 Drawing Sheet

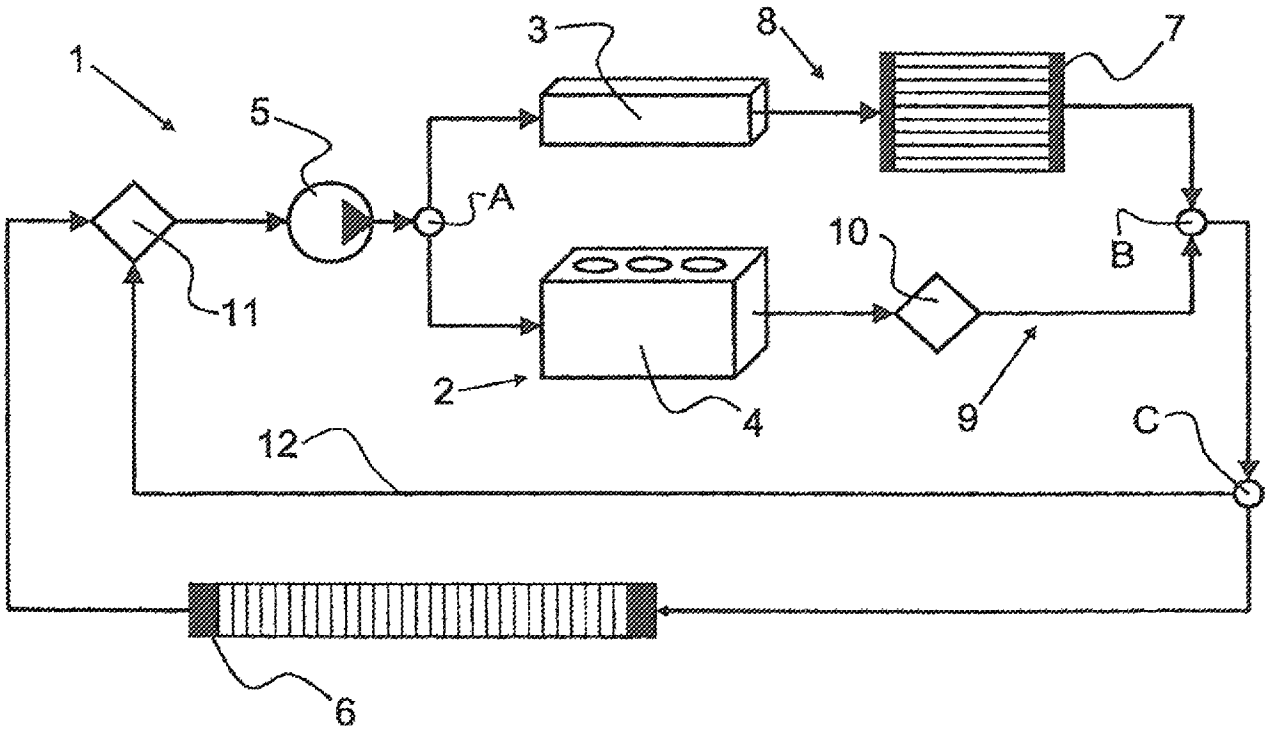
1
2
3
4
5
6
7
8
9
10
11
12
A
B
C

COOLING CIRCUIT FOR AN INTERNAL COMBUSTION ENGINE

Cooling circuit for an internal combustion engine, especially for an internal combustion engine with separate flow through the cylinder head and cylinder crankcase, and a heat exchanger for cooling of operating media of the internal combustion engine.

BACKGROUND OF THE INVENTION

Such cooling circuits are used in automotive engineering to dissipate heat from the internal combustion engine and to cool operating media of the internal combustion engine, such as, for example, exhaust gas, fresh gas, or lubricants, as a result of which the efficiency and/or the exhaust gas composition of the internal combustion engine can be influenced.

DE 10 2004 052 137 A1 shows a dual circuit cooling system for an internal combustion engine with a crankcase and a cylinder head. The crankcase is incorporated into the crankcase coolant circuit while the cylinder head is incorporated into a separate cylinder head coolant circuit. Both coolant circuits are fed from a common coolant pump. The crankcase coolant circuit can be closed by an actuating element, as a result of which the crankcase heats up more quickly after a cold start. Furthermore, it is possible to operate the two coolant circuits at different temperature levels.

DE 103 32 947 A1 likewise describes an internal combustion engine for a motor vehicle with a dual circuit cooling system in which the cylinder head and cylinder crankcase have separate coolant branches which are supplied from a coolant pump via a common feed. The coolant on the cylinder head and the cylinder crankcase, after exiting from the corresponding parts, is combined again and recirculated to the coolant pump. In so doing, the coolant can be routed alternately via one branch with the exhaust gas cooler, heat exchanger of the heating system, and oil cooler to the coolant pump or routed via a second branch alternately to the primary heat exchanger or bypassing the primary heat exchanger directly to the coolant pump.

However, the disadvantage is that the exhaust gas cooler for the illustrated coolant circuit can be supplied only with coolant which has already flowed through the entire engine, i.e., both the cylinder head and also the cylinder crankcase, and is heated accordingly. This results in efficiency losses in the cooling of the exhaust gas. Moreover, the integration of two different branches for return of the coolant to the coolant pump requires a large installation space.

The object of this invention is therefore to make available a cooling circuit for an internal combustion engine in which there can be a heat exchanger which can be operated as efficiently as possible for cooling of operating media of the internal combustion engine with low installation space requirements.

SUMMARY OF THE INVENTION

A cooling circuit for an internal combustion engine, having an internal combustion engine with at least one cylinder head and one crankcase, a coolant pump, a primary heat exchanger, and a heat exchanger for an operating medium of the internal combustion engine, the cooling circuit downstream of the coolant pump being divided between a branch site and a connection site so that at least one cylinder head is incorporated in a cylinder head branch circuit and the crankcase is incorporated in a crankcase branch circuit, and whereby the heat exchanger for an operating medium is located in the cylinder head branch circuit downstream of the at least one cylinder head.

Because the heat exchanger for an operating medium of the internal combustion engine is incorporated into the cylinder head branch circuit downstream of the cylinder head and upstream of the connecting site, coolant of the cylinder head branch circuit, which coolant is cooler compared to the crankcase branch circuit, flows through it. In this way, the operating medium can be better cooled in the corresponding heat exchanger; this benefits the efficiency and/or the exhaust gas composition of the internal combustion engine. Of course, in addition to the indicated components of the cooling circuit, still other elements such as the heat exchanger of a heating system can also be integrated as required.

In one preferred version, a shutoff valve is located in the crankcase branch circuit downstream of the crankcase. The shutoff valve can regulate the volumetric flow of coolant in the crankcase branch circuit. Shutoff of the crankcase branch circuit, preferably after starting of the internal combustion engine, can thus yield faster heating of the latter.

In one preferred version, the primary heat exchanger is located downstream of the connection site. The primary heat exchanger has the greatest cooling capacity and can be supplied with coolant from the cylinder head and the crankcase.

In one preferred version, there is a control valve between the coolant pump and the primary heat exchanger. The control valve regulates the volumetric flow of coolant to be supplied to the coolant pump.

In one preferred version, between the main water-cooled radiator and the connection site, a bypass line which is coupled to the control valve branches off. The bypass line is used for bypass of the primary heat exchanger, as necessary, by the coolant from the cylinder head and the crankcase being branched off downstream of the connection site and being supplied to the control valve. The control valve can be switched between flow through the bypass line or the primary heat exchanger, depending on temperature. For this purpose, the control valve is preferably designed as a map-controlled thermostat.

In one preferred version, flow takes place in parallel through two or more cylinder heads in the cylinder head branch circuit, and the heat exchanger for the operating medium is located downstream of the cylinder heads. There are several cylinder heads in internal combustion engines with cylinder banks having a V or W configuration. These heads are incorporated in parallel into the cylinder head branch circuit, the coolant from the cylinder heads being collected again before supply to the heat exchanger of the operating medium.

In one preferred version, the heat exchanger for an operating medium is designed as a charging air cooler. A charging air cooler is used for cooling of fresh air which has been compressed by a supercharger, as a result of which efficiency gains can be achieved.

In one preferred version, the heat exchanger for an operating medium is designed as an exhaust gas cooler. In an exhaust gas cooler, at least part of the exhaust gas emerging from the internal combustion engine is cooled in order to supply it as an inert gas to the combustion process in the internal combustion engine (exhaust gas recirculation). The resulting reduction of the combustion temperature reduces the proportion of nitrogen oxides in the exhaust gas.

BRIEF DESCRIPTION OF THE DRAWING

The FIGURE shows a schematic view of the cooling circuit of an internal combustion engine.

DETAILED DESCRIPTION OF THE PREFERRED EMBODIMENT OF THE INVENTION

According to the FIGURE, an internal combustion engine 2 has a crankcase 4 comprising cylinders in individual combustion chambers, and a cylinder head 3 which contains the devices required for gas exchange of the combustion chambers. The internal combustion engine 2 in its operation converts chemical energy into mechanical and thermal energy, for which reason it is incorporated into a cooling circuit 1 for heat dissipation. In the illustrated dual circuit cooling system, the coolant pump 5 conveys coolant to the internal combustion engine 2, the coolant flow being divided at a branch site A into two parallel branch circuits 8 and 9. The cylinder head 3 is incorporated into a cylinder head branch circuit 8 and the crankcase 4 into a crankcase branch circuit 9. As a result of the conversion of energy which takes place primarily in the combustion chambers of the crankcase 4, the crankcase 4 heats up more quickly and more dramatically than the cylinder head 3 during operation of the internal combustion engine 2. The branch circuits 8 and 9 are combined again downstream of the cylinder head 3 or of the crankcase 4 at a connection site B. In the cylinder head branch circuit 8, between the cylinder head 3 and connection site B, there is a heat exchanger 7 for an operating medium of the internal combustion engine 2. Operating media in this context are gases or liquids which are required for operation of the internal combustion engine 2, such as, for example, exhaust gas, fresh gas, or lubricant. In the crankcase branch circuit 9, between the crankcase 4 and connection site B, there is a shutoff valve 10 by means of which the crankcase branch circuit 9 can be blocked off if necessary for purposes of faster heating of the internal combustion engine 2, especially of the crankcase 4.

The shutoff valve 10 can preferably be designed as a turning valve which is actuated by a negative pressure. Coolant travels from the connection site B to a primary heat exchanger 6 and from the latter to a control valve 11. The output of the control valve 11 is connected to the intake side 5 of the coolant pump 5. Between the connection site B and the primary heat exchanger 6, at the bypass branch C, a bypass line 12 branches off through which coolant from the internal combustion engine 2 can travel to the control valve 11, bypassing the main water-cooled radiator 6, and thus to the coolant pump 5. The control valve 11, for this purpose, can preferably be designed as a map-controlled thermostat or a rotary slide valve with two feeds and one output. Of course, the cooling circuit 1 according to the invention is not limited to the illustrated components. Rather, additional heat exchangers of the heating system, oil coolers, water-cooled radiators, etc., can be integrated into the cooling circuit 1 of a partial circuit thereof.

The invention claimed is:

1. A cooling circuit for an internal combustion engine, having an internal combustion engine with at least one cylinder head and one crankcase, a coolant pump, a primary heat exchanger, and a heat exchanger for an operating medium of the internal combustion engine, the cooling circuit downstream of the coolant pump being divided between a branch site (A) and a connection site (B) so that at least one cylinder head is incorporated in a cylinder head branch circuit and the crankcase is incorporated in a crankcase branch circuit wherein the heat exchanger for an operating medium is located in the cylinder head branch circuit downstream of the at least one cylinder head.

2. The cooling circuit according to claim 1 wherein, a shutoff valve is located in the crankcase branch circuit downstream of the crankcase.

3. The cooling circuit according to claim 1 wherein, the primary heat exchanger is located downstream of the connection site (B).

4. The cooling circuit according to claim 1 wherein, there is a control valve between the coolant pump and the primary heat exchanger.

5. The cooling circuit according to claim 4 wherein, the control valve is designed as a map-controlled thermostat.

6. The cooling circuit according to claim 1 wherein, between the primary heat exchanger and the connection site (B), a bypass line which is coupled to the control valve branches off.

7. The cooling circuit according to claims 1 wherein, flow takes place in parallel through two or more cylinder heads in the cylinder head branch circuit and the heat exchanger for an operating medium is located downstream of the cylinder heads.

8. The cooling circuit according to claim 1 wherein, the heat exchanger for an operating medium is designed as a charging air cooler.

9. The cooling circuit according to claim 1 wherein, the heat exchanger for an operating medium is designed as an exhaust gas cooler.

10. A cooling system for an internal combustion chamber of a motor vehicle comprising:

a first fluid circuit including a crankcase of said engine, a primary heat exchanger and a pump for propelling a cooling fluid therethough; and a second fluid circuit including at least one cylinder head of said engine and at least one of a second heat exchanger interconnecting a first juncture point of said first circuit between said pump and said crankcase and a second juncture point of said first circuit between said crankcase and said first heat exchanger.

11. A system according to claim 10 including a shutoff valve between said crankcase and said second juncture point.

12. A system according to claim 10 including a control valve in said first circuit between said primary heat exchanger and said pump.

13. A system according to claim 12 including a third circuit interconnecting said first circuit at a third junction point disposed between said second junction and said primary heat exchanger, and said control valve.

14. A system according to claim 12 wherein said controll valve is thermostatically operated.

15. A system according to claim 10 wherein said first heat exchanger has a greater capacity than said second heat exchanger.

16. A system according to claim 10 wherein said second heat exchanger is disposed in one of a group consisting of an exhaust gas recirculating line, a heating system, an oil cooler and a radiator.

* * * * *